US011629556B2

(12) United States Patent
Melsheimer

(10) Patent No.: US 11,629,556 B2
(45) Date of Patent: Apr. 18, 2023

(54) DIRECTIONAL DRILL BIT ATTACHMENT TOOLS AND METHOD

(71) Applicant: Melfred Borzall, Inc., Santa Maria, CA (US)

(72) Inventor: Eric Melsheimer, Santa Maria, CA (US)

(73) Assignee: Melfred Borzall, Inc., Santa Maria, CA (US)

( * ) Notice: Subject to any disclaimer, the term of this patent is extended or adjusted under 35 U.S.C. 154(b) by 252 days.

(21) Appl. No.: 15/904,158

(22) Filed: Feb. 23, 2018

(65) Prior Publication Data

US 2019/0264507 A1 Aug. 29, 2019

(51) Int. Cl.

| | |
|---|---|
| ***E21B 17/046*** | (2006.01) |
| ***E21B 7/08*** | (2006.01) |
| ***E21B 7/06*** | (2006.01) |
| ***E21B 47/017*** | (2012.01) |
| *E21B 7/04* | (2006.01) |

(52) U.S. Cl.

CPC ..... *E21B 7/064* (2013.01); *E21B 17/046* (2013.01); *E21B 47/017* (2020.05); *E21B 7/046* (2013.01)

(58) Field of Classification Search

CPC ..... E21B 7/064; E21B 17/046

See application file for complete search history.

(56) References Cited

U.S. PATENT DOCUMENTS

| | | | | |
|---|---|---|---|---|
| 4,531,592 | A | 7/1985 | Hayatdavoudi | |
| 5,020,608 | A * | 6/1991 | Oden | E21B 7/064 175/21 |
| 5,176,211 | A | 1/1993 | Halderman | |
| 5,456,552 | A | 10/1995 | Cherrington | |
| 5,931,240 | A | 8/1999 | Cox | |
| 6,209,660 | B1 | 4/2001 | Cox | |
| 6,250,403 | B1 | 6/2001 | Beckwith | |
| 6,250,404 | B1 | 6/2001 | Gunsaulis | |
| 6,260,634 | B1 | 7/2001 | Wentworth | |
| 6,470,979 | B1 | 10/2002 | Wentworth | |
| 6,644,421 | B1 | 11/2003 | Long | |
| 7,147,065 | B2 | 12/2006 | Tjader | |
| 7,243,737 | B2 | 7/2007 | Michael | |
| 8,122,979 | B1 | 2/2012 | Wright, Jr. | |
| 8,225,885 | B2 | 7/2012 | Wentworth | |
| 8,365,841 | B2 | 2/2013 | Dimitroff | |
| 9,732,560 | B2 * | 8/2017 | Fontana | E21B 47/01 |
| 2001/0017222 | A1 | 8/2001 | Wentworth | |

(Continued)

OTHER PUBLICATIONS

USPTO; Notice of Allowance issued in U.S. Appl. No. 15/623,145 dated Dec. 12, 2018.

(Continued)

*Primary Examiner* — Robert E Fuller

(74) *Attorney, Agent, or Firm* — Fitch, Even, Tabin & Flannery LLP

(57) ABSTRACT

A drill head assembly may include a sonde housing and a drill bit. Two or more alignment posts protruding from the steering face of the sonde housing may mate with holes on the underside of a Horizontal Directional Drilling (HDD) drill bit and are used to align the drill bit and transfer much of the forces from the drill bit to the sonde housing. The alignment posts reduce the load on the drill bit mounting bolts and help prevent these bolts from breaking while drilling in difficult ground conditions.

18 Claims, 7 Drawing Sheets

(56) References Cited

U.S. PATENT DOCUMENTS

| | | | | |
|---|---|---|---|---|
| 2002/0112890 | A1 | 8/2002 | Wentworth | |
| 2004/0182698 | A1* | 9/2004 | Feltsman | C23C 14/566 204/298.11 |
| 2005/0056463 | A1 | 3/2005 | Aronstam | |
| 2009/0095532 | A1 | 4/2009 | Laird | |
| 2009/0272578 | A1 | 11/2009 | MacDonald | |
| 2010/0044102 | A1 | 2/2010 | Rinzler | |
| 2012/0118640 | A1 | 5/2012 | Runquist | |
| 2012/0152621 | A1 | 6/2012 | Wright | |
| 2013/0168154 | A1 | 7/2013 | Webb | |
| 2019/0211854 | A1* | 7/2019 | Nola | F16B 19/02 |

OTHER PUBLICATIONS

USPTO; Non-Final Office Action issued in U.S. Appl. No. 15/623,145 dated Oct. 22, 2018.

Melsheimer; U.S. Appl. No. 14/181,545, filed Feb. 14, 2014.

Melsheimer; U.S. Appl. No. 15/623,145, filed Jun. 14, 2017.

Schlumberger Oilfield Glossary entries for "bit nozzle" and "drillpipe"; accessed via www.glossary.oilfield.slb.com (Notice of References Cited by USPTO Nov. 29, 2016).

Schlumberger Oilfield Glossary entry for "drill pipe" accessed Feb. 15, 2017 via http://www.glossary.oilfield.slb.com/Terms/d/drill_pipe.aspx (Notices of References Cited by USPTO Feb. 17, 2017).

USPTO; Advisory Action issued in U.S. Appl. No. 14/181,545 dated Feb. 17, 2017.

USPTO; Final office action issued in U.S. Appl. No. 14/181,545 dated Nov. 29, 2016.

USPTO; Non-final office action issued in U.S. Appl. No. 14/181,545 dated May 25, 2016.

USPTO; Notice of Allowance issued in U.S. Appl. No. 14/181,545 dated Mar. 31, 2017.

* cited by examiner

DIRECTIONAL DRILL BIT ATTACHMENT TOOLS AND METHOD

BACKGROUND OF THE INVENTION

1. Field of the Invention

The present invention relates generally to horizontal drilling, and more specifically to horizontal drilling using an improved sonde housing/drill bit interface.

2. Discussion of the Related Art

Various systems and processes are known in the art for horizontal drilling using an improved sonde housing.

Horizontal Directional Drilling (HDD) is a construction method alternative to open trenching. HDD may be used for installing conduits such as cables, pipes, and the like for underground utilities. In many HDD projects, a "pilot bore" is first made using a steerable drilling tool, typically consisting of a sonde housing and a drill bit. Together, the sonde housing and drill bit form the "drill head assembly".

Due to the combination of rotation and pushing forces on a drill bit during HDD, the drill bit sees tremendous forces that must be transmitted to the sonde housing. When drilling in rocky or hard grounds, these forces can be particularly large. These forces can cause the mounting bolts to break, resulting in loss of the drill bit, possible damage to the sonde housing and failure to complete the bore.

SUMMARY

A drill head assembly may include a sonde housing and a drill bit. Two or more alignment posts protruding from the steering face of the sonde housing may mate with holes on the underside of a Horizontal Directional Drilling (HDD) drill bit and are used to align the drill bit and transfer much of the forces from the drill bit to the sonde housing. The alignment posts reduce the load on the drill bit mounting bolts and help prevent these bolts from breaking while drilling in difficult ground conditions.

A sonde housing for a drilling apparatus is described. The sonde housing may include a cylindrical sonde housing having a central axis, a first end and a second end, a drill pipe coupling section at the second end configured to couple to an end of a drill pipe, a steering face at the first end, having an angled relationship with the central axis of from between 5 degrees and 45 degrees, and having a plurality of fastener holes, and a plurality of alignment posts protruding from the steering face.

An assembly for a directional drilling apparatus is described. The assembly may include a cylindrical sonde housing having a central axis, a first end and a second end, a drill pipe coupling section at the second end configured to couple to an end of a drill pipe, a steering face at the first end, having an angled relationship with the central axis of from between 5 degrees and 45 degrees, and having a plurality of fastener holes, and a plurality of alignment posts protruding from the steering face. The assembly also includes a drill bit with a plurality of drilling teeth at a first end of the drill bit, a flat surface at a second end of the drill bit, the flat surface comprising a second plurality of fastener holes, the second plurality of fastener holes being aligned with the first plurality of fastener holes, the flat surface further comprising a plurality of alignment holes aligned with the alignment posts, and a plurality of fasteners, each passing through respective pairs of the first plurality of fastener holes and the second plurality of fastener holes.

Another assembly for a directional drilling apparatus is described. The assembly may include a cylindrical sonde housing having a central axis, a first end and a second end, a drill pipe coupling section at the second end configured to couple to an end of a drill pipe, a steering face at the first end, having an angled relationship with the central axis of from between 5 degrees and 45 degrees, and having a plurality of fastener holes, and a plurality of alignment holes in the steering face. The assembly also includes a drill bit with a plurality of drilling teeth at a first end of the drill bit, a flat surface at a second end of the drill bit, the flat surface comprising a second plurality of fastener holes, the second plurality of fastener holes being aligned with the first plurality of fastener holes, the flat surface further comprising a plurality of alignment posts aligned with the alignment holes, and a plurality of fasteners, each passing through respective pairs of the first plurality of fastener holes and the second plurality of fastener holes.

A method of making a directional drilling apparatus is described. The method may include forming a cylindrical sonde housing having a central axis, a first end and a second end, forming a drill pipe coupling section at the second end configured to couple to an end of a drill pipe, forming a steering face at the first end, having an angled relationship with the central axis of from between 5 degrees and 45 degrees, and having a plurality of fastener holes, and forming a plurality of alignment posts protruding from the steering face.

In some examples of the sonde housing, assembly, and method described above, the sonde housing comprises two alignment posts. In some examples of the sonde housing, assembly, and method described above, the alignment posts are cylindrical, oval, diamond, or hexagonal shaped.

In some examples of the sonde housing, assembly, and method described above, the fastener holes are threaded. In some examples of the sonde housing, assembly, and method described above, the fastener holes comprise at least three fastener holes.

Some examples of the sonde housing, assembly, and method described above may further include two holes in the steering face of the sonde housing. In some examples of the sonde housing, assembly, and method described above, the two alignment posts are positioned in the two holes in the steering face.

In some examples of the sonde housing, assembly, and method described above, the two alignment posts are machined in the steering face.

Some examples of the sonde housing, assembly, and method described above may further include a cavity on a side of the sonde housing. Some examples of the sonde housing, assembly, and method described above may further include a cover plate configured to removably cover the cavity.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1:
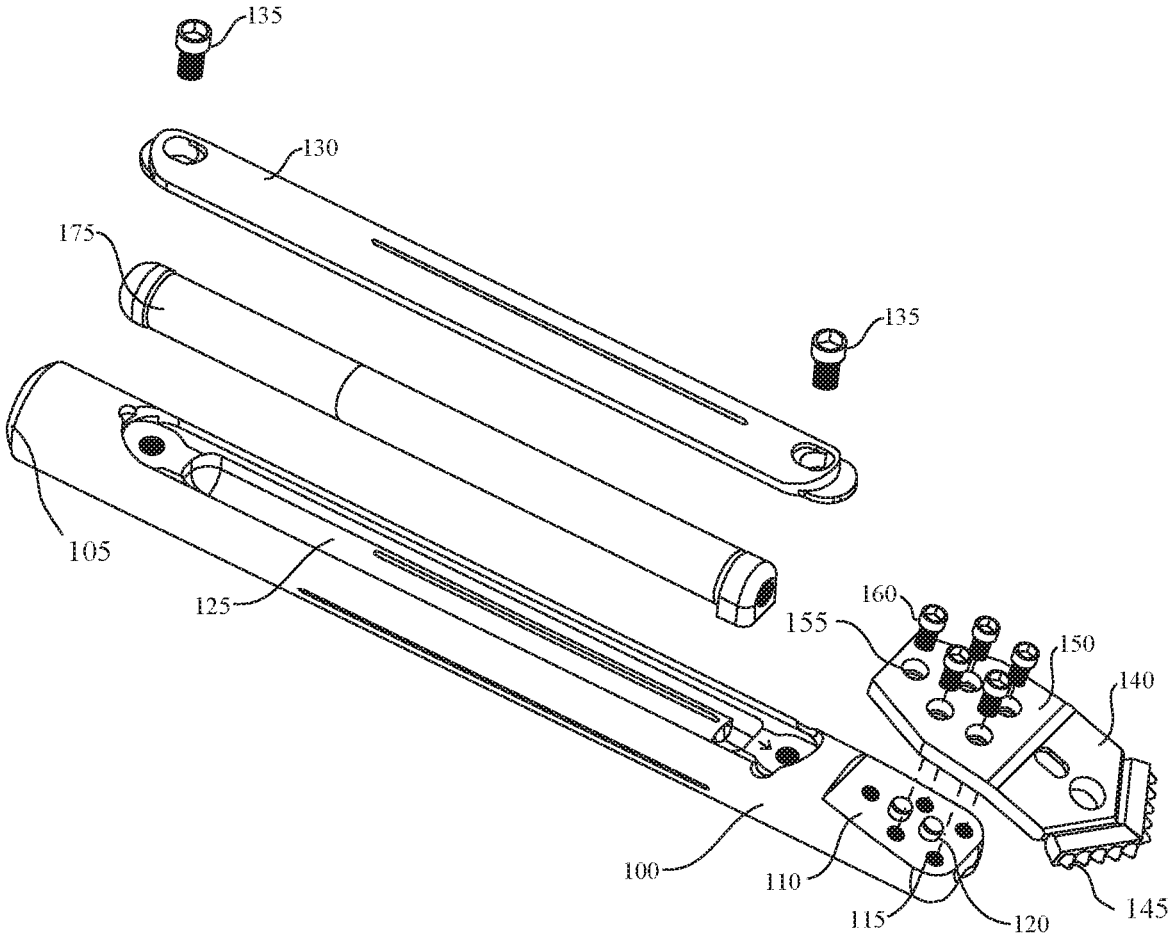
FIG. 1 shows an example of exploded view of a drill head assembly in accordance with aspects of the present disclosure.

FIG. 1 shows an example of exploded view of a drill head assembly in accordance with aspects of the present disclosure. The example shown includes sonde housing 100, drill bit 140, fasteners 160, and tracking electronics 175.

A drill head assembly may include a sonde housing 100 and a drill bit 140. The sonde housing 100 may contain transmitting electronics 175 so that the bore path may be tracked while underground. The drill bit 140 may be a flat "paddle bit" or "duckbill bit" which is bolted to an angled face 110 at the front of the sonde housing 100. In some examples, 3 to 6 socket head cap screw type bolts are used to attach the drill bit 140 to the sonde housing 100.

The drill bit 140 serves two main purposes. When the drill head assembly is rotated, the drill bit 140 cuts a hole into the ground for the bore to proceed forward in a generally straight direction. When a steering correction is made, the drill head assembly is pushed forward into the ground. The drill bit 140, which may be angled relative to the central axis of the drill head assembly, deflects the drill head assembly and allows direction changes to be made. With a combination of rotational drilling and steering pushes, the drill head can be guided along the desired bore path.

A cover plate 130 may attach to the sonde housing 100 with bolts or other fasteners 135 to keep the sonde located inside the housing. A drill bit 140 attaches to the angled steering face 110 of the sonde housing 100. The drill bit 140 does the cutting and steering for the Horizontal Directional Drilling (HDD) pilot bore. With use, the drill bit 140 will wear out and need to be replaced. To be replaceable, the drill bit 140 is attached to the sonde housing 100 with fasteners, so the used bit can be removed and a new one attached.

Two or more alignment posts 120 may be mounted to the steering face 110 of the sonde housing 100 by inserting them into holes in the steering face 110. These alignment posts 120 may have an interference fit or a close fit with the holes in the sonde housing 100 steering face 110. They may also be glued or brazed into place. For example, for an interference fit, the diameter of the mounting holes in the sonde housing steering face should be between 0.003" and 0.0005" smaller than the diameter of the alignments posts 120. If the alignment posts 120 are glued or brazed into the holes in the sonde housing steering face, the diameter of the holes may be between 0.001" and 0.030" larger than the diameter of the alignment posts 120.

The underside of the drill bit 140 may have a mating pattern of alignment holes (not shown). These holes are the same diameter or up to 0.030" larger than the diameter of the alignment posts 120. The difference between the hole diameter and the alignment post diameter must be less than the difference between the diameter of the bolt holes and the diameter of the fasteners (bolts). By making the difference in diameter between the alignment posts 120 and the corresponding holes 155 on the underside of the drill bit 140 smaller than the difference in diameter between the fasteners and the corresponding holes in the drill bit, any relative motion between the drill bit 140 and steering face 110 should be constrained by the fit of the alignment posts 120 to the holes on the underside of drill bit 140 rather than the fit of the drill bit fasteners 160 to the drill bit fastener holes 155 and the steering face fastener holes 115. The drill bit 140 is mounted to the steering face 110 of the sonde housing 100 by aligning the alignment posts 120 with the holes on the underside of the drill bit 140. The fasteners 160 (i.e., drill bit 140 mounting bolts) may be installed and tightened to securely attach the drill bit 140 to the sonde housing 100.

The use of the load carrying alignment posts 120 increases the strength of the attachment of the drill bit 140 to the sonde housing 100 and reduces the load seen by the mounting bolts 160. Any loading caused by side to side motion of the drill bit 140 relative to the drill head will be taken up by the alignment posts 120 rather than the mounting bolts because of the close fit of the alignment posts 120 to the holes. The bolts keep the drill bit 140 clamped to the sonde housing 100 while the alignment posts 120 take the majority of the load being transferred from the drill bit 140 to the sonde housing 100.

The load carrying alignment posts 120 can be of a variety of configurations. In some cases, they are cylindrical and solid to provide strength. However, diamond and other shaped alignment posts 120 can also be used. Hollow alignment posts 120 or alignment posts 120 with threads on the interior or exterior can also be used. In some embodiments, threaded alignment posts 120 make removal and replacement of installed alignment posts 120 easier.

In some cases, there are at least two load carrying alignment posts 120. Three or more alignment posts 120 can be used. Using more alignment posts 120 may increase the load carrying capacity of the assembly. In some cases, the alignment posts 120 are arranged in a pattern to maximize the load carrying capacity. For example, the alignment posts 120 may be arranged longitudinally along a central axis of the sonde housing 100. Other patterns may also be used. For example, three alignment pins may be arranged in a longitudinal or a triangular pattern.

In some embodiments, the alignment posts 120 are removable, making the drill head assembly easier to repair.

In other embodiments, the alignment posts 120 may be machined bosses protruding from the steering face 110 of the sonde housing 100 or the drill bit 140. If the alignment posts 120 are machined on the drill bit 140 the alignment holes may be on the sonde housing 100 steering face 110. In some cases, one or more of the load carrying alignment posts 120 may be non-cylindrical.

Sonde housing 100 may have a central axis, a first end and a second end. Sonde housing 100 may be an example of, or include aspects of, the corresponding elements described with reference to FIGS. 2, 3, and 4. Sonde housing 100 may include drill pipe coupling section 105, steering face 110, cavity 125, and cover plate 130.

In some examples, drill pipe coupling section 105 may be located at the second end of the sonde housing 100 and may be configured to couple to an end of a drill pipe (not shown).

In some examples, steering face 110 may be located at the first end of the sonde housing 100, and may have an angled relationship with the central axis of from between 5 degrees and 45 degrees, and having a plurality of fastener holes 115 and be an example of two holes in the steering face 110 of the sonde housing 100 or any combination thereof. In some examples, the fastener holes 115 comprise at least three fastener holes 115.

Steering face 110 may be an example of, or include aspects of, the corresponding elements described with reference to FIG. 4. Steering face 110 may include fastener holes 115 and alignment post 120. In some examples, the fastener holes 115 are threaded. Fastener holes 115 may be an example of, or include aspects of, the corresponding elements described with reference to FIG. 4.

In some examples, a plurality of alignment posts 120 are protruding from the steering face 110. In some examples, the sonde housing 100 comprises two alignment posts 120. In some examples, the alignment posts 120 are cylindrical, oval, diamond, or hexagonal shaped. In some examples, the two alignment posts 120 are positioned in the two holes in the steering face 110. In some examples, the two alignment posts 120 are machined in the steering face 110 or any combination thereof. Alignment posts 120 may be an example of, or include aspects of, the corresponding elements described with reference to FIGS. 3 and 4.

In some examples, cavity 125 may be on a side of the sonde housing 100. In some examples, cover plate 130 may be configured to removably cover the cavity 125. Cover plate 130 may be an example of, or include aspects of, the corresponding elements described with reference to FIG. 2. Cover plate 130 may include or be attached with cover plate mounting bolts 135.

Drill bit 140 may be an example of, or include aspects of, the corresponding elements described with reference to FIGS. 2, 3, and 5. Drill bit 140 may include drilling teeth 145, flat surface 150, and drill bit fastener holes 155. In some examples, drilling teeth 145 may be an example of a plurality of drilling teeth 145 at a first end of the drill bit 140.

In some examples, flat surface 150 may be at a second end of the drill bit 140, the flat surface 150 comprising a second plurality of fastener holes (Drill bit fastener holes 155), the second plurality of fastener holes being aligned with the first plurality of fastener holes 115, and the flat surface 150 further comprising a plurality of alignment holes aligned with the alignment posts 120. Drill bit fastener holes 155 may be an example of, or include aspects of, the corresponding elements described with reference to FIG. 5.

In some examples, fasteners 160 may pass through respective pairs of the first plurality of fastener holes and the second plurality of fastener holes. Fasteners 160 may be an example of, or include aspects of, the corresponding elements described with reference to FIGS. 2 and 3.

Figure 2:
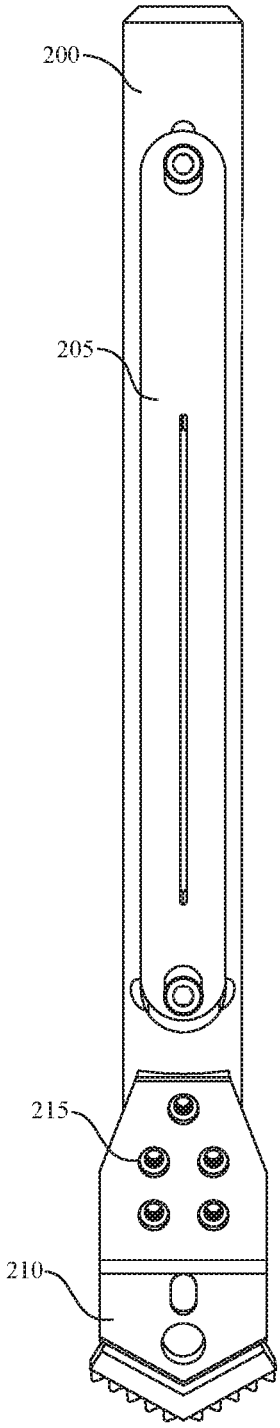
FIG. 2 shows an example of top view of a drill head assembly in accordance with aspects of the present disclosure.

FIG. 2 shows an example of a top view of a drill head assembly in accordance with aspects of the present disclosure. The example shown includes sonde housing 200, drill bit 210, and fasteners 215.

In some examples, sonde housing 200 may be an example of a cylindrical sonde housing 200 having a central axis, a first end and a second end. Sonde housing 200 may be an example of, or include aspects of, the corresponding elements described with reference to FIGS. 1, 3, and 4.

Sonde housing 200 may include cover plate 205. In some examples, cover plate 205 may be an example of a cover plate 205 configured to removably cover the cavity. Cover plate 205 may be an example of, or include aspects of, the corresponding elements described with reference to FIG. 1.

Drill bit 210 may be an example of, or include aspects of, the corresponding elements described with reference to FIGS. 1, 3, and 5. Fasteners 215 may be an example of, or include aspects of, the corresponding elements described with reference to FIGS. 1 and 3.

Figure 3:
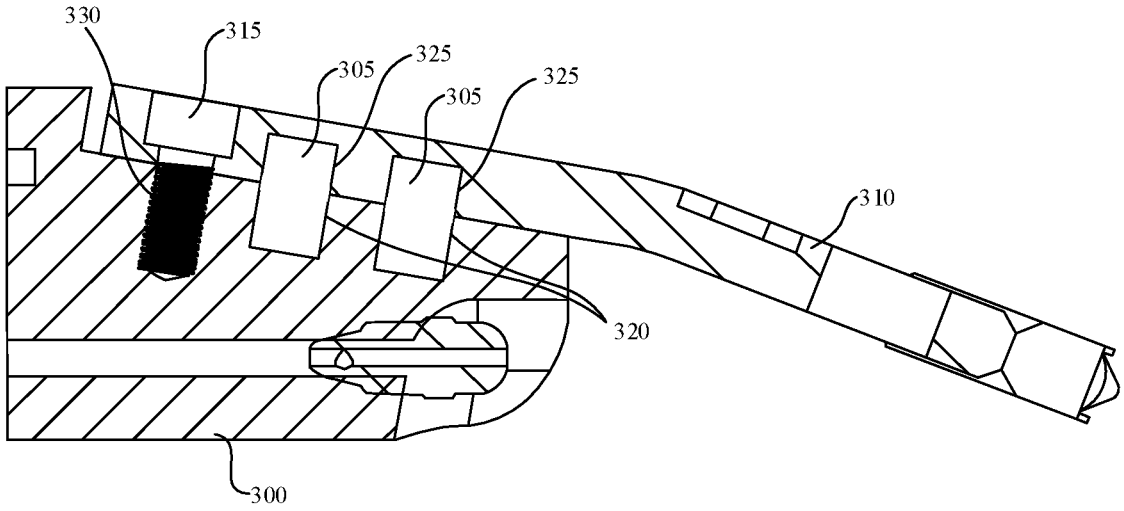
FIG. 3 shows an example of partial section view of a drill head assembly in accordance with aspects of the present disclosure.

FIG. 3 shows an example of partial section view of a drill head assembly in accordance with aspects of the present disclosure. The example shown includes sonde housing 300, drill bit 310, and fasteners 315.

In some examples, sonde housing 300 may be an example of a cylindrical sonde housing 300 having a central axis, a first end and a second end. Sonde housing 300 may be an example of, or include aspects of, the corresponding elements described with reference to FIGS. 1, 2, and 4.

In some examples, the steering face of the sonde housing 300 may include alignment posts 305. Alignment post 305 may protrude from the steering face of the sonde housing 300 (with mating holes in the drill bit 310). In the embodiment shown in FIG. 3, a plurality of blind alignment holes 320 in the steering face of the sonde housing 300 and corresponding blind alignment holes 325 in the drill bit 310 receive the alignment posts 305. A plurality of blind holes 330 in the steering face of the sonde housing receive the fasteners 315. In other examples alignment post 305 may be attached to the drill bit 310, or be detachable from both the sonde housing 300 and drill bit 310.

Alignment posts 305 may be an example of, or include aspects of, the corresponding elements described with reference to FIGS. 1 and 4. Drill bit 310 may be an example of, or include aspects of, the corresponding elements described with reference to FIGS. 1, 2, and 5. Fasteners 315 may be an example of, or include aspects of, the corresponding elements described with reference to FIGS. 1 and 2.

Figure 4:
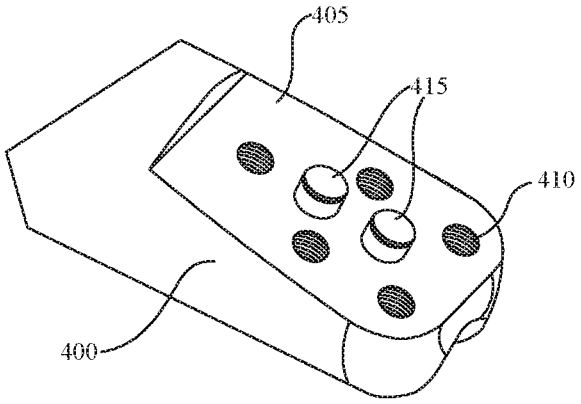
FIG. 4 shows an example of perspective view of a steering face in accordance with aspects of the present disclosure.

FIG. 4 shows an example of perspective view of a steering face 405 in accordance with aspects of the present disclosure. The example shown includes sonde housing 400.

In some examples, sonde housing 400 may be an example of a cylindrical sonde housing 400 having a central axis, a first end and a second end. Sonde housing 400 may be an example of, or include aspects of, the corresponding elements described with reference to FIGS. 1, 2, and 3.

Sonde housing 400 may include steering face 405. In some examples, steering face 405 may be located at the first end sonde housing 400, having an angled relationship with the central axis of from between 5 degrees and 45 degrees, and having a plurality of fastener holes 410. In some examples, the fastener holes 410 comprise at least three fastener holes 410.

Steering face 405 may be an example of, or include aspects of, the corresponding elements described with reference to FIG. 1. Steering face 405 may include fastener holes 410 and alignment posts 415. In some embodiments, the alignment posts 415 are attached to a drill bit (not shown), and the steering face 405 has alignment holes (not shown) to receive the alignment posts 415.

Fastener holes 410 may be an example of, or include aspects of, the corresponding elements described with reference to FIG. 1. In some examples, the fastener holes 410 are threaded.

In some examples, alignment posts 415 may protrude from the steering face 405. Alignment posts 415 may be an example of, or include aspects of, the corresponding elements described with reference to FIGS. 1 and 3.

Figure 5:
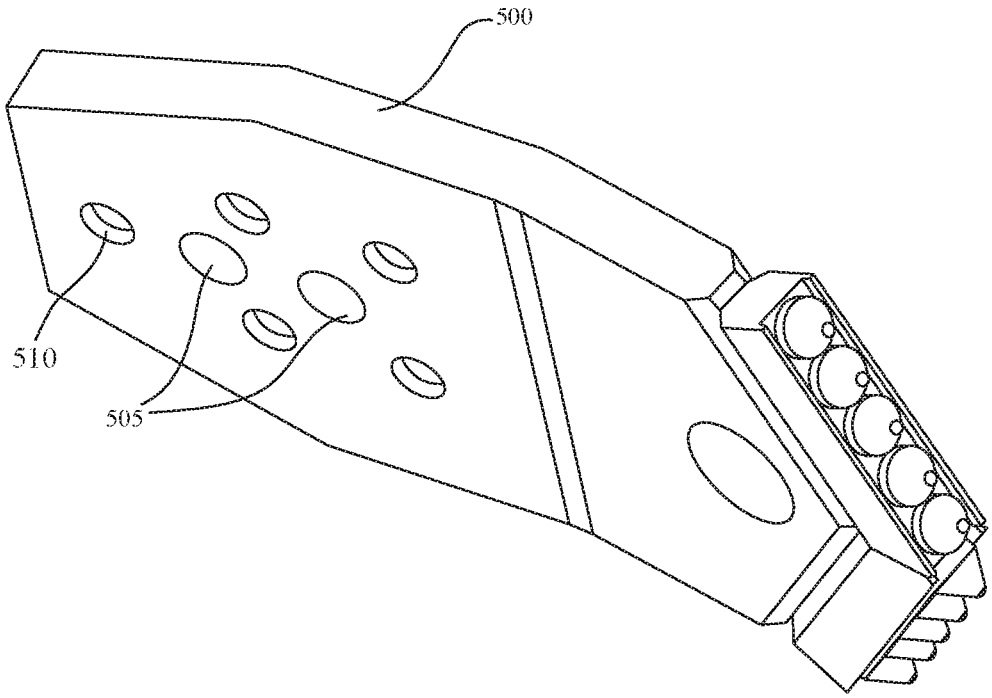
FIG. 5 shows an example of perspective view of a drill bit in accordance with aspects of the present disclosure.

FIG. 5 shows an example of perspective view of a drill bit 500 in accordance with aspects of the present disclosure. Drill bit 500 may be an example of, or include aspects of, the corresponding elements described with reference to FIGS. 1, 2, and 3.

Drill bit 500 may include alignment holes 505 and drill bit fastener holes 510. Drill bit fastener holes 510 may be an example of, or include aspects of, the corresponding elements described with reference to FIG. 1.

In some embodiments (not shown), the drill bit has alignment posts protruding from the flat surface, which match up with alignment holes on a steering face (not shown).

Figure 6:
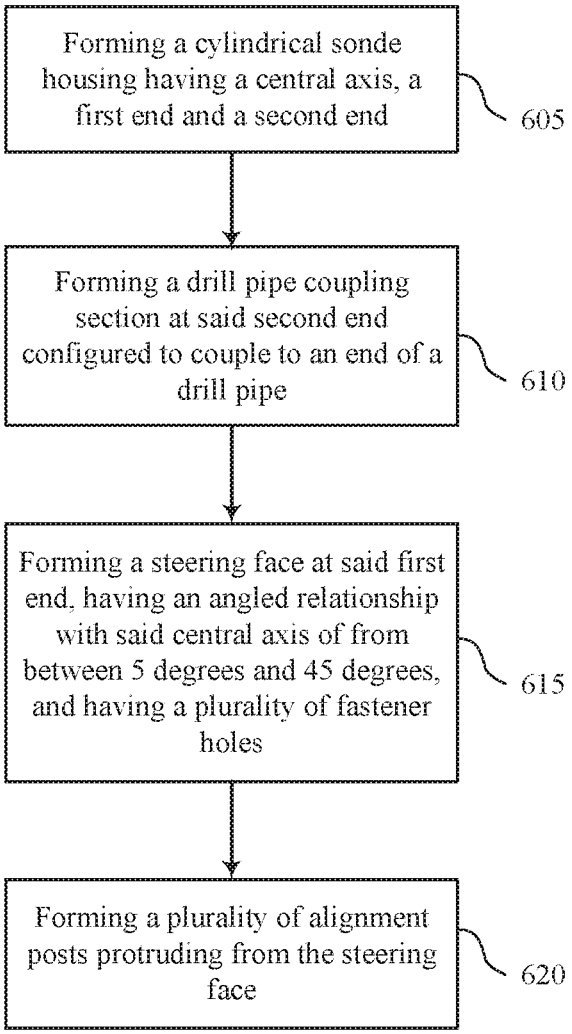
FIG. 6 shows an example of manufacturing a sonde housing in accordance with aspects of the present disclosure.

FIG. 6 shows an example of a method for manufacturing a sonde housing in accordance with aspects of the present disclosure. In some examples, these operations may be performed by a manufacturing system, which may include a processor executing a set of codes to control functional elements of an apparatus. Additionally, or alternatively, the processes may be performed manually, or using special-purpose hardware. In some cases, the operations may be composed of various substeps.

At step 605, the system may form a cylindrical sonde housing having a central axis, a first end and a second end. In some cases, the product of this step may be a sonde housing as described with reference to FIGS. 1, 2, 3, and 4.

At step 610, the system may form a drill pipe coupling section at the second end configured to couple to an end of a drill pipe. In some cases, the product of this step may be a drill pipe coupling section as described with reference to FIG. 1.

At step 615, the system may form a steering face at the first end, having an angled relationship with the central axis of from between 5 degrees and 45 degrees, and having a plurality of fastener holes. In some cases, the product of this step may be a steering face as described with reference to FIGS. 1 and 4.

At step 620, the system may form a plurality of alignment posts. In some embodiments the alignment posts are protruding from the steering face. In other cases, they extend from a drill bit. In some cases, the product of this step may be an alignment post as described with reference to FIGS. 1, 3, and 4. In some cases, the alignment posts are machined from the steering face.

Figure 7:
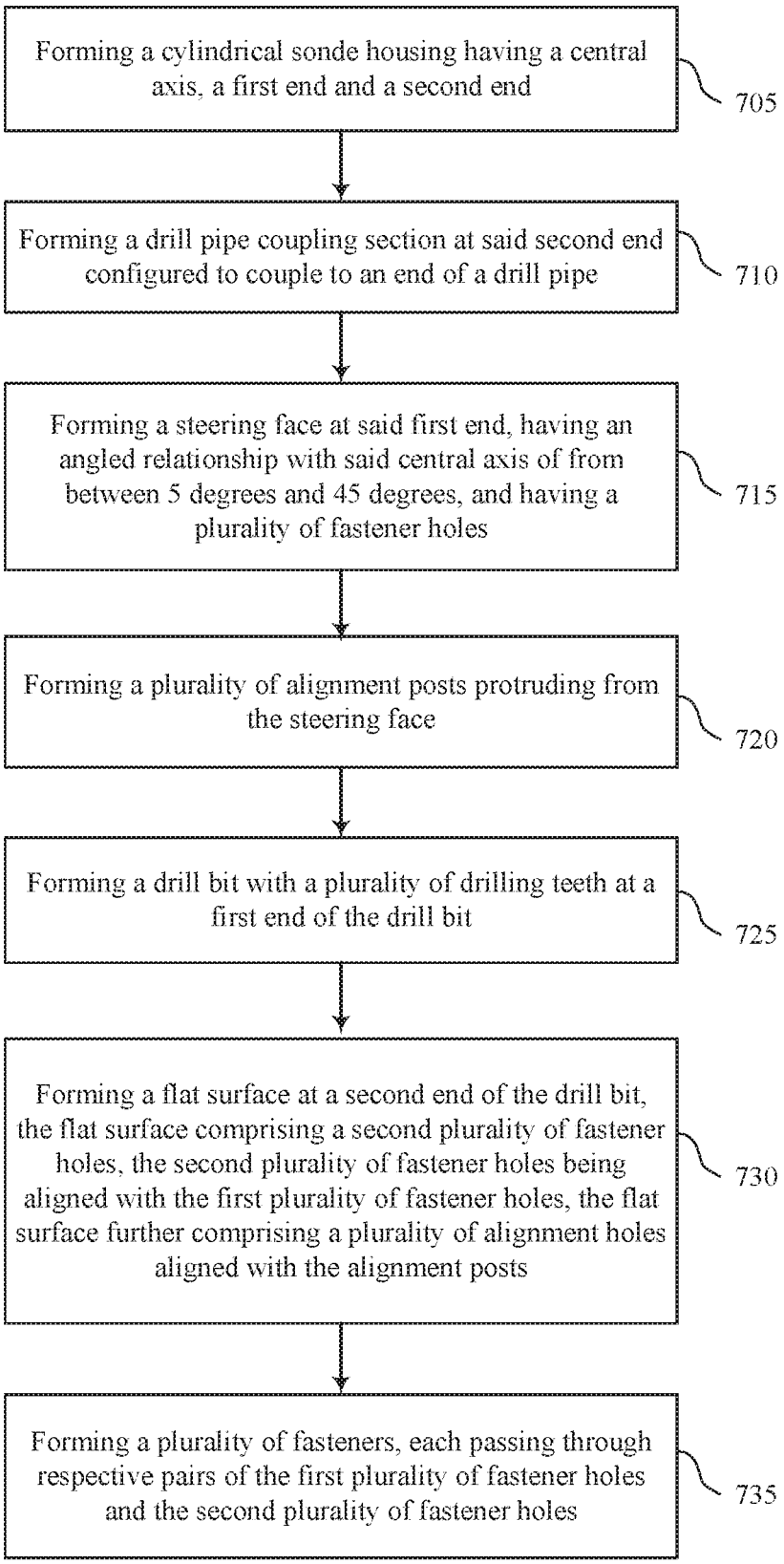
FIG. 7 shows an example of manufacturing a drill head assembly in accordance with aspects of the present disclosure.

FIG. 7 shows an example of a method for manufacturing a drill head assembly in accordance with aspects of the present disclosure. In some examples, these operations may be performed by a manufacturing system, which may include a processor executing a set of codes to control functional elements of an apparatus. Additionally, or alternatively, the processes may be performed manually, or using special-purpose hardware. In some cases, the operations may be composed of various substeps.

At step 705, the system may form a cylindrical sonde housing having a central axis, a first end and a second end. In some cases, the product of this step may be a sonde housing as described with reference to FIGS. 1, 2, 3, and 4.

At step 710, the system may form a drill pipe coupling section at the second end configured to couple to an end of a drill pipe. In some cases, the product of this step may be a drill pipe coupling section as described with reference to FIG. 1.

At step 715, the system may form a steering face at the first end, having an angled relationship with the central axis of from between 5 degrees and 45 degrees, and having a plurality of fastener holes. In some cases, the product of this step may be a steering face as described with reference to FIGS. 1 and 4.

At step 720, the system may form a plurality of alignment posts. In some embodiments the alignment posts are protruding from the steering face. In other cases, they extend from a drill bit. In some cases, the product of this step may be an alignment post as described with reference to FIGS. 1, 3, and 4.

At step 725, the system may form a plurality of drilling teeth at a first end of the drill bit. In some cases, the product of this step may be a drilling teeth as described with reference to FIG. 1.

At step 730, the system may form a flat surface at a second end of the drill bit, the flat surface comprising a second plurality of fastener holes, the second plurality of fastener holes being aligned with the first plurality of fastener holes.

In some cases, the flat surface further comprises a plurality of alignment holes aligned with the alignment posts. In other cases, the alignment posts themselves extend from the flat surface. In some cases, the product of this step may be a flat surface as described with reference to FIG. 1.

At step 735, the system may form a plurality of fasteners, each passing through respective pairs of the first plurality of fastener holes and the second plurality of fastener holes. In some cases, the product of this step may be a fastener as described with reference to FIGS. 1, 2, and 3.

While the invention herein disclosed has been described by means of specific embodiments, examples and applications thereof, numerous modifications and variations could be made thereto by those skilled in the art without departing from the scope of the invention set forth in the claims.

What is claimed is:

1. An assembly for a directional drilling apparatus comprising:

a sonde housing comprising:

a cylindrical sonde housing having a central axis, a first end and a second end;

a drill pipe coupling section at said second end configured to couple to an end of a drill pipe;

a steering face at said first end, having an angled relationship with said central axis of from between 5 degrees and 45 degrees, and having a first plurality of fastener holes; and a plurality of alignment posts protruding from the steering face, wherein each alignment post is inserted in a corresponding blind hole of the steering face, wherein a diameter of each blind hole of the steering face is between 0.001" and 0.030" larger than a diameter of the corresponding alignment post, whereby each alignment post is removably coupled to the sonde housing;

a drill bit comprising:

a plurality of drilling teeth at a first end of the drill bit;

a flat surface at a second end of the drill bit, the flat surface comprising a second plurality of fastener holes, the second plurality of fastener holes being aligned with the first plurality of fastener holes, the flat surface further comprising a plurality of drill bit blind alignment holes aligned with the alignment posts, wherein the drill bit blind alignment holes are configured to be close fit with the alignment posts wherein a diameter of each drill bit blind alignment hole is at least equal to a diameter of the corresponding alignment post and is up to 0.030" larger than the diameter of the corresponding alignment post; and a plurality of fasteners, each passing through respective pairs of the first plurality of fastener holes and the second plurality of fastener holes, wherein a difference between a drill bit alignment hole diameter and an alignment post diameter is less than a difference between a diameter of the second plurality of fastener holes and a diameter of a portion of the fastener passing through the second plurality of fastener holes, whereby loading caused by side to side motion of the drill bit is transferred from the drill bit to the sonde housing by the alignment posts rather than the fasteners.

2. The assembly of claim 1, wherein:

said sonde housing comprises two alignment posts.

3. The assembly of claim 2, wherein:

said alignment posts are cylindrical, oval, diamond, or hexagonal shaped.

4. The assembly of claim 3, wherein:

said first plurality of fastener holes are threaded.

5. The assembly of claim 3, wherein:

said fastener holes comprise at least three fastener holes.

6. The assembly of claim 1, the assembly further comprising:

a cavity on a side of said sonde housing; and a cover plate configured to removably cover said cavity.

7. A method of making a directional drilling apparatus, comprising:

forming a cylindrical sonde housing having a central axis, a first end and a second end;

forming a drill pipe coupling section at said second end configured to couple to an end of a drill pipe;

forming a steering face at said first end, having an angled relationship with said central axis of from between 5 degrees and 45 degrees, and having a first plurality of fastener holes;

forming a plurality of blind alignment holes in said flat surface;

inserting a plurality of alignment posts, wherein a diameter of each blind alignment hole of the steering face is between 0.001" and 0.030" larger than a diameter of the corresponding alignment post, in the plurality of blind alignment holes such that the alignment posts are protruding from the steering face, whereby each alignment post is removably coupled to the sonde housing;

forming a drill bit, wherein forming the drill bit comprises:

forming a plurality of drilling teeth at a first end of the drill bit; and forming a flat surface at a second end of the drill bit, the flat surface comprising a second plurality of fastener holes, the second plurality of fastener holes being aligned with the first plurality of fastener holes, the flat surface further comprising a plurality of drill bit blind alignment holes aligned with the alignment posts, wherein a diameter of each drill bit blind alignment hole is at least equal to a diameter of the aligned alignment post and is up to 0.030" larger than the diameter of the aligned alignment post;

coupling the drill bit to the sonde housing by seating the alignment posts in the plurality of drill bit blind alignment holes; and coupling the drill bit to the sonde housing by passing a plurality of fasteners through respective pairs of the first plurality of fastener holes and the second plurality of fastener holes, wherein a difference between a drill bit alignment hole diameter and an alignment post diameter is less than a difference between a diameter of the second plurality of fastener holes and a diameter of a portion of the fastener passing through the second plurality of fastener holes, whereby loading caused by side to side motion of the drill bit is transferred from the drill bit to the sonde housing by the alignment posts rather than the fasteners.

8. The method of claim 7, wherein:

said sonde housing comprises two alignment posts in two blind holes.

9. The method of claim 8, wherein:

said alignment posts are cylindrical, oval, diamond, or hexagonal shaped.

10. The method of claim 7, wherein:

said fastener holes are threaded.

11. The method of claim 7, wherein:

said fastener holes comprise at least three fastener holes.

12. The method of claim 7, the method further comprising:

forming a cavity on a side of said sonde housing; and forming a cover plate configured to removably cover said cavity.

13. An assembly for a directional drilling apparatus comprising:

a sonde housing comprising:

a cylindrical sonde housing having a central axis, a first end and a second end;

a drill pipe coupling section at said second end configured to couple to an end of a drill pipe; and a steering face at said first end, having an angled relationship with said central axis of from between 5 degrees and 45 degrees, and having a first plurality of fastener holes and a first plurality of blind alignment holes;

a drill bit comprising:

a plurality of drilling teeth at a first end of the drill bit;

a flat surface at a second end of the drill bit, the flat surface comprising a second plurality of fastener holes, the second plurality of fastener holes being aligned with the first plurality of fastener holes, the flat surface further comprising a second plurality of blind alignment holes and a plurality of alignment posts inserted in the first plurality of blind alignment holes and protruding from the flat surface, wherein a diameter of each of the first plurality of blind holes is between 0.001" and 0.030" larger than a diameter of the corresponding alignment post, wherein each alignment post is inserted in one of the second plurality of blind alignment holes, wherein a diameter of each of the second plurality of blind alignment hole is at least equal to a diameter of the corresponding alignment post and is up to 0.030" larger than the diameter of the corresponding alignment post, whereby each alignment post is removably coupled to the drill bit and wherein the alignment posts are aligned with the first plurality of alignment holes; and a plurality of fasteners, each passing through respective pairs of the first plurality of fastener holes and the second plurality of fastener holes, wherein a difference between an alignment hole diameter of the second plurality of alignment holes and an alignment post diameter is less than a difference between a diameter of the second plurality of fastener holes and a diameter of a portion of the fastener passing through the second plurality of fastener holes, whereby loading caused by side to side motion of the drill bit is transferred from the drill bit to the sonde housing by the alignment posts rather than the fasteners.

14. The assembly of claim 13, wherein:

said drill bit comprises two alignment posts.

15. The assembly of claim 13, wherein:

said alignment posts are cylindrical, oval, diamond, or hexagonal shaped.

16. The assembly of claim 13, wherein:

said first plurality of fastener holes are threaded.

17. The assembly of claim 13, wherein:

said fastener holes comprise at least three fastener holes.

18. The assembly of claim 13, the assembly further comprising:

a cavity on a side of said sonde housing; and a cover plate configured to removably cover said cavity.

* * * * *